US011151819B2

(12) United States Patent
Huang et al.

(10) Patent No.: US 11,151,819 B2
(45) Date of Patent: Oct. 19, 2021

(54) ACCESS CONTROL METHOD, ACCESS CONTROL APPARATUS, SYSTEM, AND STORAGE MEDIUM

(71) Applicant: SHENZHEN SENSETIME TECHNOLOGY CO., LTD., Guangdong (CN)

(72) Inventors: Xiang Huang, Shenzhen (CN); Zhonghua She, Shenzhen (CN); Wenchao Zhou, Shenzhen (CN); Liping Xiao, Shenzhen (CN)

(73) Assignee: SHENZHEN SENSETIME TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 16/699,535

(22) Filed: Nov. 29, 2019

(65) Prior Publication Data

US 2020/0105081 A1 Apr. 2, 2020

Related U.S. Application Data

(63) Continuation of application No. PCT/CN2018/116541, filed on Nov. 20, 2018.

(30) Foreign Application Priority Data

Jul. 9, 2018 (CN) ..... 201810749562.4

(51) Int. Cl.
*G07C 9/00* (2020.01)

(52) U.S. Cl.
CPC ..... *G07C 9/00563* (2013.01); *G07C 9/00309* (2013.01)

(58) Field of Classification Search
CPC ... G07C 9/37; G07C 9/003–9; G06K 9/00288
See application file for complete search history.

(56) References Cited

U.S. PATENT DOCUMENTS

2009/0217315 A1* 8/2009 Malik ..... H04N 7/181 725/9
2012/0126939 A1* 5/2012 Chang ..... G07C 9/00563 340/5.53

(Continued)

FOREIGN PATENT DOCUMENTS

CN 101140620 A 3/2008
CN 102024157 A 4/2011

(Continued)

OTHER PUBLICATIONS

First Office Action of the Chinese application No. 201810749562.4, dated May 29, 2020.

(Continued)

*Primary Examiner* — Fabricio R Murillo Garcia
(74) *Attorney, Agent, or Firm* — Pattao LLC; Junjie Feng

(57) ABSTRACT

An access control method, an access control apparatus, a system, and a storage medium are disclosed. The method includes: acquiring a scene image, and recognizing one or more face images in the scene image; determining an attribute of the face image, the attribute including a registered user and an unregistered user; and if multiple face images are recognized, determining whether attributes corresponding to the multiple face images include the registered user, and responsive to determining that the attributes corresponding to the multiple face images comprise the registered user, controlling an access control device to be opened; responsive to determining that the attributes corresponding to the multiple face images does not comprise the registered user, in condition that an access control verification request instruction is received and verification for the access control verification request instruction succeeds, controlling the access control device to be opened.

19 Claims, 6 Drawing Sheets

(56) References Cited

U.S. PATENT DOCUMENTS

| | | | | |
|---|---|---|---|---|
| 2013/0047229 | A1* | 2/2013 | Hoefel | G06F 21/62 726/7 |
| 2016/0104035 | A1* | 4/2016 | Wang | H04N 21/4318 382/118 |
| 2017/0032601 | A1* | 2/2017 | Zhou | G07C 9/37 |
| 2017/0046507 | A1* | 2/2017 | Archer | H04W 12/02 |
| 2017/0169287 | A1* | 6/2017 | Tokunaga | G06K 9/00912 |
| 2017/0357845 | A1* | 12/2017 | Yamaoka | G06K 9/00221 |

FOREIGN PATENT DOCUMENTS

| | | | |
|---|---|---|---|
| CN | 104183042 | A | 12/2014 |
| CN | 106534222 | A | 3/2017 |
| CN | 106611152 | A | 5/2017 |
| CN | 106846564 | A | 6/2017 |
| CN | 107274516 | A | 10/2017 |
| CN | 107564144 | A | 1/2018 |
| CN | 108122314 | A | 6/2018 |
| CN | 108198295 | A | 6/2018 |
| CN | 108230517 | A | 6/2018 |
| JP | 2004362283 | A | 12/2004 |
| JP | 2006134081 | A | 5/2006 |
| JP | 2007335918 | A | 12/2007 |
| JP | 2008071205 | A | 3/2008 |
| JP | 2009199223 | A | 9/2009 |
| JP | 2009205392 | A | 9/2009 |
| JP | 2011070277 | A | 4/2011 |
| JP | 2012032728 | A | 2/2012 |
| JP | 2013097568 | A | 5/2013 |
| JP | 2017215737 | A | 12/2017 |
| KR | 20170033534 | A | 3/2017 |

OTHER PUBLICATIONS

International Search Report in the international application No. PCT/CN2018/116541, dated Apr. 9, 2019.

First Office Action of the Japanese application No. 2019-566181, dated Nov. 24, 2020.

Second Office Action of the Chinese application No. 201810749562.4, dated Sep. 27, 2020.

First Office Action of the Korean application No. 10-2019-7035596, dated Jun. 29, 2021.

* cited by examiner

ACCESS CONTROL METHOD, ACCESS CONTROL APPARATUS, SYSTEM, AND STORAGE MEDIUM

CROSS-REFERENCE TO RELATED APPLICATIONS

The present application is a continuation of International Application No. PCT/CN2018/116541 filed on Nov. 20, 2018, which is based on and claims priority to Chinese Patent Application No. 201810749562.4, filed on Jul. 9, 2018. The disclosures of these applications are incorporated herein by reference in their entirety.

BACKGROUND

In order to strengthen security protection and ease the pressure of manual identity verification, offices in office buildings or mansions generally use access control systems for attendance check and restriction on personnel access.

In the related art, although swiping an access card for passing is simple and fast, the access card is easy to lose or transfer to others. Therefore, this method is not conducive to obtaining real attendance, and is not conducive to security maintenance, either. In addition to the card swiping method, fingerprint clock in is also a common method; however, in practical application of fingerprint clock in, the surface of an apparatus for obtaining fingerprints is easily dirty, and many people have fingerprints that are not obvious. Therefore, during fingerprint recognition clock in, on the contrary, more time is spent, the error rate also significantly increases, and the flow of people is also blocked at morning rush hour. Besides, in general, when there are visitors, employees with an access authority are asked to actively open the door to let them in and out.

In a word, the access control methods of both card swiping and fingerprint clock in are inefficient and are not conducive to visitor management.

SUMMARY

The present disclosure relates to, but is not limited to, the technical field of security protection, and in particular, to an access control method, an access control apparatus, a system, and a storage medium.

In view of this, embodiments of the present disclosure expect to provide an access control method, an access control apparatus, a system, and a storage medium, capable of effectively improving the access control efficient and tightening visitor management.

According to the first aspect, some embodiments provide an access control method, the method including: acquiring a scene image, and recognizing one or more face images in the scene image; determining one or more attributes of the one or more face images, each attribute including a registered user and an unregistered user; in condition that the scene image includes multiple face images, determining whether the attributes corresponding to the multiple face images include the registered user; if the attributes corresponding to the multiple face images comprise the registered user, sending an opening instruction to an access control device, and controlling the access control device to be opened; if the attributes corresponding to the multiple face images comprise no registered user, determining whether an access control verification request instruction is received; and in response to reception of the access control verification request instruction, in condition that verification for the access control verification request instruction succeeds, sending the opening instruction to the access control device, and controlling the access control device to be opened.

According to a second aspect, the embodiments provide an access control apparatus, the access control apparatus including units configured to implement the method according to the first aspect above, and the access control apparatus including: an acquiring unit, configured to acquire a scene image; a recognizing unit, configured to recognize one or more face images in the scene image; a determining unit, configured to determine one or more attributes of the one or more face images, each attribute including a registered user and an unregistered user; a judging unit, configured to, in condition that the scene image includes multiple face images, determine whether the attributes corresponding to the multiple face images include the registered user; a controlling unit, configured to, if the attributes corresponding to the multiple face images include the registered user, send an opening instruction to an access control device, and control the access control device to be opened; or if the attributes corresponding to the multiple face images comprise no registered user, determining whether an access control verification request instruction is received; a receiving unit, configured to receive an access control verification request instruction; and a verifying unit, configured to verify the access control verification request instruction. The judging unit is further configured to determine whether the access control verification request instruction is received; and the controlling unit is further configured to: in response to reception of the access control verification request instruction, in condition that verification for the access control verification request instruction succeeds, send the opening instruction to the access control device, and control the access control device to be opened.

According to a third aspect, some embodiments provide an access control system, including an access control apparatus and an access control device. The access control apparatus is configured to control the access control device to be opened or closed so as to restrict the passing of a visitor. In one embodiment, the access control apparatus is configured to implement the method according to the first aspect and any possible implementation thereof.

According to a fourth aspect, some embodiments provide another access control apparatus, including a processor, a communication interface, and a memory, which are connected to each other. The communication interface is configured to perform data exchange with other electronic devices, the memory is configured to store a computer program that supports the access control apparatus to implement the method above, he computer program includes program instructions, and the processor is configured to invoke the program instructions to implement the method according to the first aspect and any possible implementation thereof.

According to a fifth aspect, some embodiments provide a computer readable storage medium, having stored thereon a computer program that, when being executed by a processor, causes the processor to implement the access control method according to the first aspect and any possible implementation thereof.

According to a sixth aspect, some embodiments provide a computer program product, including a computer readable storage medium having a computer program stored thereon, and the computer program is operable to cause a computer to implement the access control method according to the first aspect and any possible implementation thereof.

According to the access control apparatuses of the present disclosure, after a scene image is acquired, one or more faces in the scene image can be rapidly recognized, so that before an access control device is controlled to let visitors pass one by one, most or even all of people in front of the access control device can be recognized by recognizing the faces in the scene image. If an access control apparatus recognizes a registered user, the access control device is controlled to be opened to let the visitors pass, but if no registered user is recognized, the access control device is not opened and verification information, i.e., an access control verification request instruction, is received, and then after the access control verification request instruction passes, the access control device is controlled to be opened. Therefore, in the embodiments, multiple faces can be rapidly recognized before visitors pass through an access control device one by one, thereby greatly shortening the time spent by a registered user from verification to passing. Furthermore, an unregistered user is allowed to pass only when a correct access control verification request instruction is input, thereby effectively restricting the passing of the unregistered user, and since a mechanical instead of manual method is used, the management efficiency for the passing of the unregistered user is also improved. On the whole, according to the present disclosure, since, the duration of identity verification for visitors is reduced and the management efficiency for the passing of the unregistered user is improved, the efficiency for access control is significantly improved.

DETAILED DESCRIPTION

Figure 1:
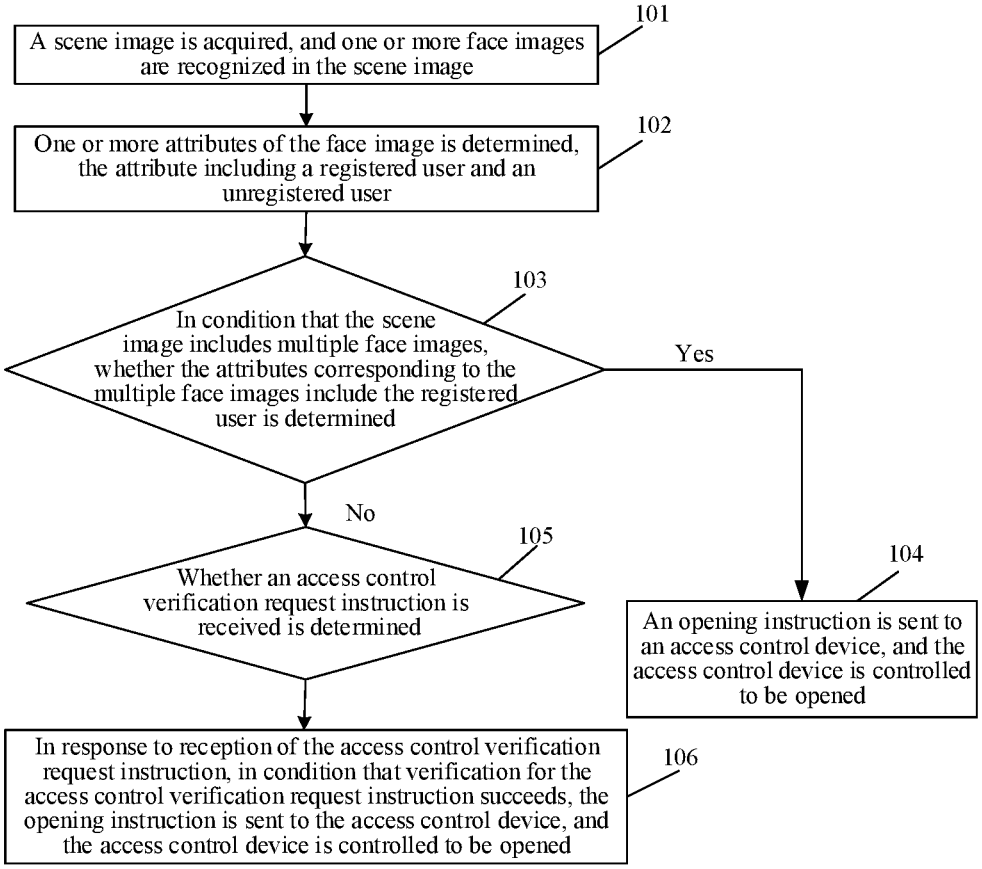
FIG. 1 is a schematic flowchart of an access control method provided in embodiments.

The technical solutions in embodiments are described below with reference to the accompanying drawings in the embodiments.

It should be understood that the terms "include" and "comprise", when used in the present description and the appended claims, specify the presence of stated features, entireties, steps, operations, elements, and/or assemblies, but do not preclude the presence or addition of one or more other features, entireties, steps, operations, elements, assemblies, and/or combinations thereof.

It should be further understood that here the terms used in the description of the present disclosure are merely intended for describing particular embodiments other than limiting the present disclosure. As used in the description and appended claims of the present disclosure, the singular forms "a", "an", and "the" are intended to include the plural forms, unless expressly stated otherwise.

It should be further understood that the term "and/or" used in the description and appended claims of the present disclosure indicate associating with any combination and all possible combinations of one or more listed items, and including all the combinations.

As used in the present description and the appended claims, the term "if" can be interpreted as "when" or "once" or "in response to determining" or "in response to detecting" according to the context. Similarly, the phase "if determining" or "if detecting [a described condition or event]" can be interpreted as "once determining" or "in response to determining" or "once detecting [a described condition or event]" or "in response to detecting [a described condition or event]" according to the context.

In practical application, the access control apparatuses described in one or more embodiments each include, but are not limited to, a terminal device having a touch sensitive surface (such as a touch screen display and/or a touch panel) and a server. Moreover, the access control devices described in the embodiments each include, but are not limited to, a terminal device having a touch sensitive surface (such as a touch screen display and/or a touch panel). The access control apparatus and the access control device can exchange data, for example, the access control apparatus is configured to receive and process data sent by the access control device, and sends a control instruction to the access control device so that the access control device performs operations, such as obtaining external data, and opening and/or closing. The terminal device includes devices such as a mobile phone, a laptop computer, or a tablet computer, and the server includes an image processing device having a touch sensitive surface (such as a touch screen display device and/or a touch panel), a desktop computer, etc. Furthermore, it should be understood that the access control apparatus and/or the access control device may also include one or more other physical user interface devices such as a keyboard, a mouse, and/or a control rod.

Access control systems are commonly used in places where there is a need to control human traffic and where security control is required, so as to achieve attendance check and restriction on personnel access, strengthen security protection, and ease the pressure of manual identity verification.

However, the use of the conventional clock in methods (such as access card swiping and fingerprint clock in) results in that data is not high in authenticity or accuracy. In addition, when there is a strange visitor, it is common to use a paper registration method to record information of the strange visitor, and then ask a person or employee with an access authority to actively open the door to let him/her in and out; this is inefficient, does not achieve effective verification for the identity of the strange visitor, and likewise does not achieve effective supervision and control for the access of the strange visitor. Therefore, the conventional access control methods are inefficient and are not conducive to strange visitor management.

In order to solve the problems above, one or more embodiments provide access control methods. The access control apparatus controls a photographing means to photograph a scene image including visitors, and then receives the scene image returned by the photographing means, so that the access control apparatus acquires the scene image; then the access control apparatus rapidly recognizes one or more faces in the scene image, so that before sending an opening instruction to the access control device, the access control apparatus can recognize most or even all of people in front of the access control device by recognizing the faces in the scene image. Moreover, if the access control apparatus recognizes multiple visitors, and the multiple visitors include a registered user, the opening instruction is sent to the access control device, so that the access control device is opened to let the multiple visitors pass; however, if the multiple visitors do not include the registered user, an access control verification request instruction for identity verification from any one of the multiple visitors is received, and then after the access control verification request instruction passes, the access control device is controlled to be opened. Therefore, some embodiments can rapidly recognize multiple visitors before the multiple visitors pass through the access control device one by one, so that the time spent for identity verification of the visitors is greatly shortened, and the multiple visitors including the registered user can be rapidly allowed to pass. Therefore, some embodiments improve the passing efficiency of an unregistered user. However, regarding the multiple visitors who do not include the registered user, the multiple visitors are allowed to pass only in the case that the access control verification request instruction input by any one of the multiple visitors passes, so that the embodiments can also effectively restrict the passing of the unregistered user. According to the methods in the embodiments, the time spent for identity verification for the multiple visitors is reduced, and the management efficient for the passing of the unregistered user is also improved. Therefore, on the whole, one or more embodiments greatly improve the access control efficiency.

Referring to FIG. 1, FIG. 1 is a schematic flowchart of an access control method disclosed in embodiments. As shown in FIG. 1, the method includes the following operations.

In block 101, a scene image is acquired, and one or more face images in the scene image are recognized.

In some embodiments, an access control apparatus controls a photographing means to acquire the scene image; after photographing the scene image, the photographing means transmits the scene image to the access control apparatus; and then the access control apparatus recognizes at least one face in the scene image, where when there are multiple faces in the scene image, the access control apparatus can recognize the multiple faces at the same time. A method for face recognition includes a geometric feature-based face recognition method, an algebraic feature-based face recognition method, a connection mechanism-based face recognition method, a three-dimensional data-based face recognition method, and/or a neural network-based face recognition method. In addition, the scene image is an image including visitors within a predetermined range of an access control device photographed by the photographing means. In some embodiments, the photographing means includes, but is not limited to, at least one of a camera, a camera lens, or a digital camera. Multiple faces in a scene image are recognized at the same time, so that the recognition time is shortened, and thus the access control efficiency is improved.

Figure 5:
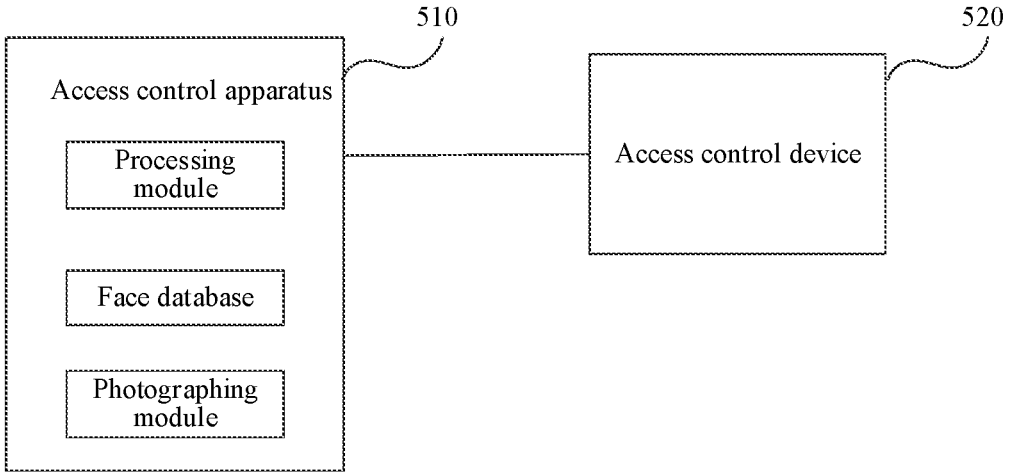
FIG. 5 is a schematic block diagram of an access control apparatus provided in embodiments.

It should be noted that the access control apparatus can control the photographing means to photograph, at a fixed position, an area within the predetermined range around the access control device to obtain the scene image, or control a lens of the photographing means to rotate or zoom to capture an area of a crowd in a hall and photograph the area of the crowd to obtain the scene image. The photographing means may be included in the access control apparatus and may also be included in another terminal device, or is an external means, which is not limited in the embodiments. An access control system as shown in FIG. 5 includes the access control apparatus and the access control device, wherein the access control device is a device used for restricting the in and out of the visitors and let the visitors pass one by one, and the access control apparatus is an apparatus used for controlling the access control device to be opened or closed.

It should be further noted that a method for implementing multi-face recognition of the access control apparatus relates to parallel recognition. In practical application, parallel recognition may be parallel recognition in terms of time or parallel recognition in terms of step. For example, if the parallel recognition above is the parallel recognition in terms of time, the access control apparatus divides time into multiple time slots, such that the access control apparatus performs recognition on a first face at odd time slots and performs recognition on a second face at even time slots, until the two faces are both recognized, i.e., the first face is recognized at time slots 1, 3, 5, . . . , (N+1), and the second face is recognized at time slots 2, 4, 6, . . . , (N+2). Similarly, if the parallel recognition above is the parallel recognition in terms of step, the image acquired by the access control apparatus includes the first face and the second face, such that the access control apparatus performs feature extraction on the second face after performing feature extraction on the first face, and then performs face matching or the like on the first face after performing feature extraction on the second face, until the two faces are both recognized. Therefore, parallel recognition on multiple face images can be achieved.

In block 102, an attribute of the face image is determined, the attribute including a registered user and an unregistered user.

In some embodiments, during face image recognition, if the face image included in the scene image has a matched face image in a face database, the attribute of the face image is the registered user; otherwise, the attribute of the face image is the unregistered user. If the attribute of the face image is the registered user, it indicates that a visitor corresponding to the face image is the registered user, such as an employee and a short-term visitor; otherwise, if the attribute of the face image is the unregistered user, it indicates that the visitor corresponding to the face image is the unregistered user, such as a strange visitor.

In block 103, in response to that the scene image includes multiple face images, it is determined whether the attributes corresponding to the multiple face images include the registered user; if the attributes corresponding to the multiple face images include the registered user, the operation in block 104 is implemented; the attributes corresponding to the multiple face images does not include the registered user, the operation in block 105 is implemented.

In practical application, if the scene image recognized by the access control apparatus includes multiple face images, and the multiple face images include the face image of which the attribute is the registered user, it indicates that the crowd corresponding to the multiple face images has the registered user, and if the multiple face images do not include the face image of which the attribute is the registered user, it indicates that the crowd is all the unregistered users.

In one or more embodiments, after acquiring the scene image, the access control apparatus can rapidly recognize one or more faces in the scene image, so that before the access control device is controlled to let visitors pass one by one, most or even all of people in front of the access control device can be recognized by recognizing the faces in the scene image. Moreover, if the scene image has the face images of multiple visitors, whether the registered user is present among the multiple visitors is detected, and if the registered user is present, the access control apparatus sends an opening instruction to the access control device so that the access control device is opened to let the visitors pass.

In the case that multiple visitors go through together, the multiple visitors may know each other, and therefore, the multiple visitors can be allowed to pass when the registered user is detected, thereby improving the access control efficiency.

In block 104, the opening instruction is sent to the access control device, and the access control device is controlled to be opened.

In some embodiments, if the multiple face images include the face image of which the attribute is the registered user, it indicates that the crowd corresponding to the multiple face images has the registered user. In this case, the multiple visitors in front of the access control apparatus may know each other, and therefore, the multiple visitors can be allowed to pass when the registered user is detected. Therefore, the access control apparatus sends the opening instruction to the access control device to open the access control device.

In block 105, it is determined whether an access control verification request instruction is receive, and upon reception of the access control verification request instruction, the operation in block 106 is implemented.

In one or more embodiments, if the multiple face images are all the face images of which the attributes are the unregistered users, it indicates that the crowd corresponding to the multiple face images is all the unregistered users. If the visitors are all the unregistered users, the visitors need to input the access control verification request instruction for identity verification on the access control device, and then the access control apparatus obtains the access control verification request instruction from the access control device, and after conforming that the access control verification request instruction is correct, sends the opening instruction to the access control device, such that the access control device is opened to let the multiple visitors pass.

In one or more embodiments, a user inputs the access control verification request instruction on the access control device; then after receiving the access control verification request instruction, the access control device sends same to the access control apparatus; and finally the access control apparatus determines whether verification for the received access control verification request instruction succeeds, and if the verification succeeds, sends the opening instruction to the access control device so that the access control device is opened. The access control verification request instruction includes an access control password, etc.

It should be noted that if the visitors are the unregistered users, it indicates that the visitors are strange visitors, i.e., neither company employees nor outsiders who have already registered. Therefore, it is necessary to verify whether the visitors are legitimate visitors, for example, making the visitors enter the access control password. The visitors can make an appointment to get a random password by applying at the front desk or on a company website, which is not limited in the embodiments. If the password verification succeeds, the visitors can obtain the authority for passing.

In block 106, in response to reception of the access control verification request instruction, in the case that verification for the access control verification request instruction succeeds, the opening instruction is sent to the access control device, and the access control device is controlled to be opened.

In some embodiments, if the access control apparatus receives the access control verification request instruction, the access control apparatus verifies the access control verification request instruction, and when the verification succeeds, sends the opening instruction to the access control device so that the access control device is opened to let the unregistered user pass.

The access control method of the embodiments above includes: acquiring a scene image, and recognizing one or more face images in the scene image; determining an attribute of the face image, the attribute including a registered user and an unregistered user; in response to a situation where the scene image includes multiple face images, determining whether the attributes corresponding to the multiple face images include the registered user; if yes, sending an opening instruction to an access control device, and controlling the access control device to be opened; otherwise, determining whether an access control verification request instruction is received; and in response to reception of the access control verification request instruction, in the case that verification for the access control verification request instruction succeeds, sending the opening instruction to the access control device, and controlling the access control device to be opened. According to the method above, when multiple visitors are recognized, and the multiple visitors include the registered user, it is not necessary for the multiple visitors to be subjected to identity verification in front of the access control device one by one for passing; however, when the multiple visitors do not include the registered user, it is necessary to perform identity verification. Therefore, according to the method of the embodiments above, the time spent for identity verification is shortened by means of multi-face recognition, and the passing efficiency of the visitors is improved. In addition, when the multiple visitors are all the unregistered users, the passing of the unregistered users is effectively restricted by means of identity verification thereon, thereby improving the security.

In some embodiments, in the case that verification for the access control verification request instruction does not succeed, a doorbell trigger interface display instruction is sent to the access control device; and/or an alarm prompt is sent.

In one or more embodiments, when the multiple visitors are all the unregistered users, and first identity verification fails, another identity verification method can be used to get a passing opportunity, i.e., the access control apparatus sends the doorbell trigger interface display instruction to the access control device so that the access control device displays a doorbell trigger interface, then the visitors can contact an administrator by means of the doorbell trigger interface, and the visitors can pass after the administrator confirms the identities thereof. Therefore, the embodiments also provide a remote manual verification method. In addition, when the first identity verification for the visitors fails, the access control apparatus can also send the alarm prompt to prompt the administrator and the visitors of a verification failure result.

For example, the visitor can call the administrator by triggering a doorbell; after the administrator makes response and confirms the identity of the visitor by means of a video and/or a voice, the access control apparatus can control the access control device to be opened. In addition, once the verification for the identity of the visitor fails, the access control apparatus can make the alarm prompt, such as flashing an alarm light, ringing an alarm, and/or displaying a warning, so as to prompt the administrator or the visitor of the verification failure result, and then the visitor can pass under the help of the administrator or is stopped by the administrator.

In some embodiments, the method further includes: in the case that the attributes corresponding to the multiple face images include the registered user and the number of the registered users is less than the number of the face images, sending an alarm prompt.

In one or more embodiments, when the unregistered user is present among the multiple visitors, the alarm prompt is made to prompt the user (the administrator) to pay attention, and/or to prompt the visitor that it is necessary to input verification information for identity verification. In the embodiments, the restriction on the passing of the unregistered user is strengthened on the basis of the first embodiment. In the first embodiment, the multiple visitors are allowed to pass as long as the registered user is present among the multiple visitors, such that even the unregistered user is present among the multiple visitors, the unregistered user can also pass together. However, such a passing mode will cause some problems because the unregistered user among the multiple visitors may not know the registered user, and the unregistered user goes along with the registered user in order to try to pass smoothly. However, in the embodiments, the multiple visitors can pass together only when they are all the registered users; otherwise, the access control apparatus makes the alarm prompt to attract the attention of the administrator, and/or to prompt the unregistered user to perform identity verification.

In some embodiments, when the one or more face images in the scene image are all the unregistered users, before the access control apparatus receives the access control verification request instruction, the method further includes: receiving an access control verification code, the access control verification code including, but not limited to, the access control password; and if verification for the access control verification code succeeds, sending the opening instruction to the access control device so that the access control device is opened.

In one or more embodiments, when it is determined that the one or more face images in the scene image are all the unregistered users, a method for obtaining the access control verification code and an input box for obtaining the access control verification request instruction are displayed on an interaction interface of the access control device. Therefore, if the visitor knows the access control verification request instruction, the visitor can directly input the access control verification request instruction in the input box; however, if the visitor does not know the access control verification request instruction, the visitor can obtains the access control verification code under the guidance of the method for obtaining the access control verification code displayed on the interaction interface and then inputs the access control verification code into the access control device, then the access control device sends the access control verification code to the access control apparatus, and in the case that the access control verification code is received and verified to be correct, the access control apparatus sends the opening instruction to the access control device so that the access control device is opened.

The method for obtaining the access control verification code for the visitor includes, for example, the visitor inputs a mobile phone number on the access control device and then can receives a short message including the access control verification code by means of a mobile phone, or the visitor sends a short message including preset content (a preset character string) to a predetermined number by means of a mobile phone, or the visitor scans a QR code on the access control device to obtain the access control verification code, etc.

The access control verification code differs from the access control verification request instruction in that the access control verification code is verification information having short timeliness and obtained on the basis of information in a visitor-held terminal device by the visitor on site, and the access control verification request instruction is verification information having long timeliness and obtained on the basis of an identity identifier (such as an ID card number and a diving license number) of the user on an official website or the front desk by the visitor before passing. However, the two kinds of verification information will both lose efficacy after verification, and thus cannot be repeatedly used. The information in the terminal device includes information on the terminal device (such as identifier information of the terminal device, and the mobile phone number) or information on a signed account in an application of the terminal device (such as information on a signed account in the application for scanning the QR code on the access control device), etc.

In some embodiments, after the recognizing multiple face images in the scene image, the method further includes: recognizing body movements between visitors to which the multiple face images respectively belong; and identifying the multiple face images with a group attribute according to the body movements, the group attribute being used for describing an interpersonal relationship between the visitors to which the multiple faces respectively belong.

In some embodiments of the present disclosure, if the scene image includes multiple face images, the body movements between the visitors to which the multiple face images respectively correspond can be further recognized, and then the relationship between the visitors can be inferred from the body movements, for example, the body movements including holding hands, shaking hands, patting on the shoulder, etc. If two visitors are shaking hands and/or patting on the shoulders, it is inferred that the two visitors may be colleagues. Similarly, if two visitors are holding hands, it is inferred that the two visitors may be a couple. Therefore, the access control apparatus can group the visitors as different groups by recognizing different body movements between the visitors. By means of the method, a simple human relationship network can be established, more information on the visitors can be obtained, and then the human relationship network can be used when necessary. Access authority modification information for a first face image is received, the access authority modification information including an access site, an access frequency, and/or an access time; and an access authority corresponding to the first face image is modified according to the access authority modification information.

In some embodiments, the user (the administrator) can set different access authorities for different visitors (i.e., the first face image, where the first face image being the face image of any visitor), and a visitor is allowed to access an allowable access site at a limited frequency within a time period allowed by the access authority. For example, according to the access authority of a visitor, the visitor only has the authority of accessing a company at the ninth floor for three times, and the access time is just between 2 pm and 6 pm.

In some embodiments, the method further includes: in the case of sending the opening instruction to the access control device, and controlling the access control device to be opened, generating a passing record corresponding to each face image, where the passing record includes at least one of a passing time, an address, or the face image.

In some embodiments, when sending the opening instruction to the access control device to control the access control device to be opened, the access control apparatus further needs to record the passing records of the passing visitors, i.e., generating the corresponding passing records for different face images. The passing record corresponding to each face image is generated, so as to facilitate subsequent query and tracking analysis of the user. The passing record includes at least one of the passing time, the address, or the face image.

Figure 2:
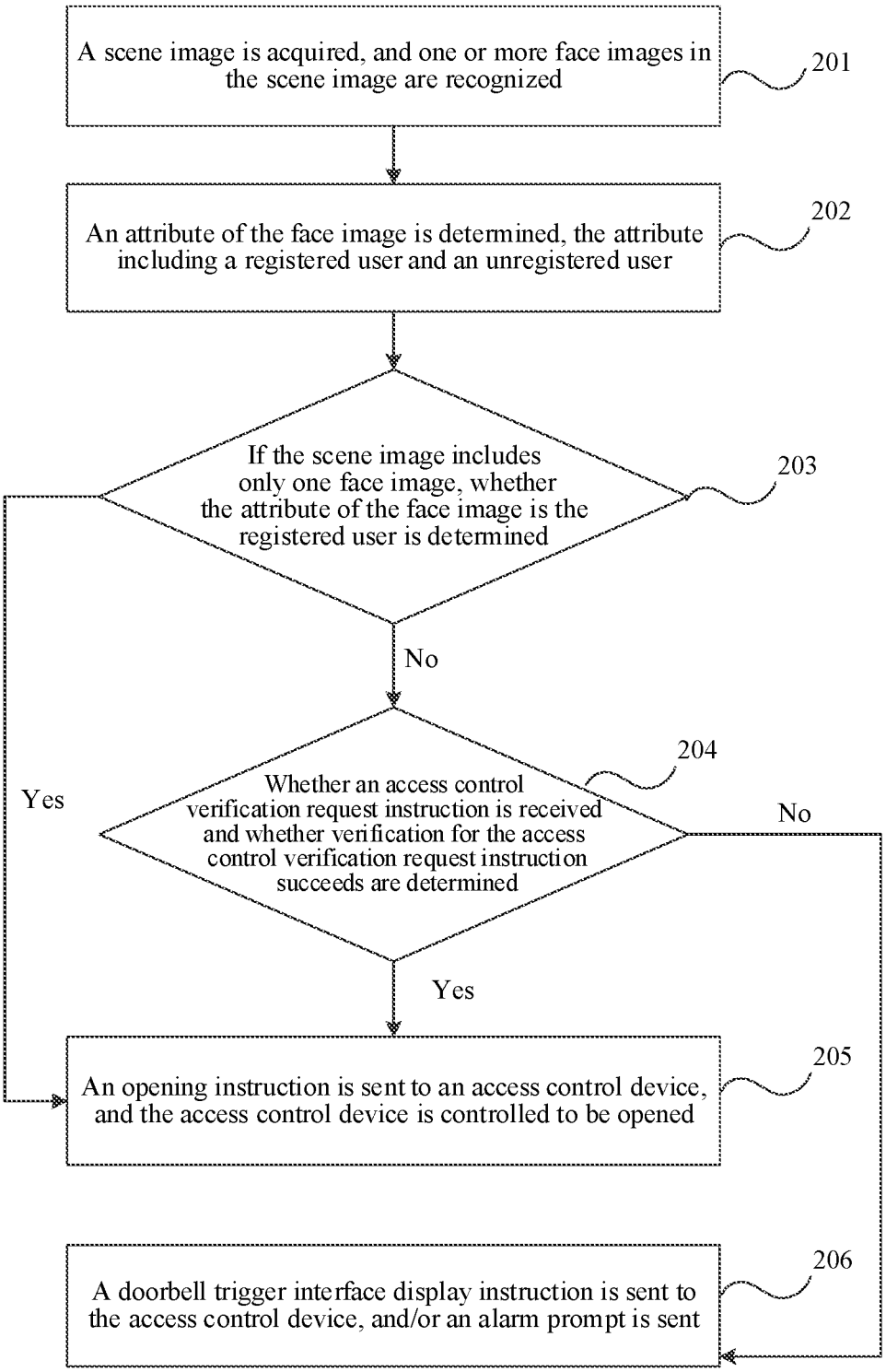
FIG. 2 is a schematic flowchart of another access control method provided in embodiments.

Referring to FIG. 2, FIG. 2 is a schematic flowchart of another access control method disclosed in embodiments. The method is applied to a situation where a scene image includes only one face image. As shown in FIG. 2, the method may include the following operations.

In block 201, a scene image is acquired, and one or more face images in the scene image are recognized.

In block 202, an attribute of the face image is determined, the attribute including a registered user and an unregistered user.

In block 203, if the scene image includes only one face image, it is determined whether the attribute of the face image is the registered user; if the attribute of the face image is the registered user, the operation in block 205 is implemented; if the attribute of the face image is not the registered user, the operation in block 204 is implemented.

In some embodiments, if the scene image includes only one face image, an access control apparatus determines whether the attribute of the face image is the registered user, i.e., determining whether a visitor to which the face image belongs is the registered user; if yes, the operation in block 205 is implemented; otherwise, the operation in block 204 is implemented.

In block 204, it is determined whether an access control verification request instruction is received and whether verification for the access control verification request instruction succeeds are determined; if yes, the operation in block 205 is implemented; otherwise, the operation in block 206 is implemented.

In one or more embodiments, if the scene image includes the unique face image and the attribute of the unique face image is the unregistered user, it indicates that the visitor to which the face image belongs is the unregistered user, and it is necessary to perform further identity verification before passing. The access control verification request instruction is sent to the access control apparatus; and then after determining that the access control verification request instruction is received and the verification for the access control verification request instruction is correct, the access control apparatus implements the operation in block 205, and otherwise, implements the operation in block 206.

In block 205, an opening instruction is sent to an access control device, and the access control device is controlled to be opened.

In some embodiments, if the scene image includes the unique face image and the attribute of the unique face image is the registered user, or if the attribute corresponding to the unique face image is the unregistered user but the access control apparatus receives the access control verification request instruction and the verification for the access control verification request instruction succeeds, the access control apparatus sends the opening instruction to the access control device, the opening instruction being used for controlling the access control device to be opened, and after receiving the opening instruction, the access control device is opened to let the visitor to which the face image above belongs pass. The access control device can let a registered visitor or a strange visitor who has not been registered but succeeds in identity verification pass.

In block 206, a doorbell trigger interface display instruction is sent to the access control device; and/or an alarm prompt is sent.

In some embodiments of the present disclosure, if the access control apparatus does not receive the access control verification request instruction, or if the access control apparatus receives the access control verification request instruction but the verification for the access control verification request instruction fails, the access control apparatus sends the alarm prompt, such as flashing an alarm light, ringing an alarm, and/or displaying a warning. The alarm prompt is used for prompting the unregistered user to make input again, and prompting the unregistered user of a verification failure result or attracting the attention of the security personnel. In addition, another identity verification opportunity can be further given to the unregistered user. In practical application, the access control apparatus sends the doorbell trigger interface display instruction to the access control device, and then after receiving the doorbell trigger interface display instruction, the access control device displays a doorbell trigger interface, the doorbell trigger interface including an icon for triggering a doorbell, such that the visitor can make a video or voice conversation with an administrator by means of operations such as clicking on the icon, thereby verifying the identity of the visitor in one embodiment. Therefore, the unregistered user can be allowed to pass by means of a remote operation of the administrator, thereby improving the access control efficiency.

Compared with the previous embodiments, the embodiments mainly describe that when the scene image includes only one face image, if the attribute of the face image is the registered user, it indicates that the visitor to which the face image belongs is the registered user, and the access control apparatus controls the access control device to be opened; however, if the attribute of the face image is the unregistered user, it indicates that the visitor to which the face image belongs is the unregistered user, and it is necessary for the unregistered user to input the access control verification request instruction to perform identity verification so as to verify whether the unregistered user is a legitimate strange visitor, where if the verification succeeds, the unregistered user is allowed to pass, and if the verification fails, the alarm prompt is made or the doorbell trigger interface is displayed, thereby improving the access control efficiency.

Figure 3:
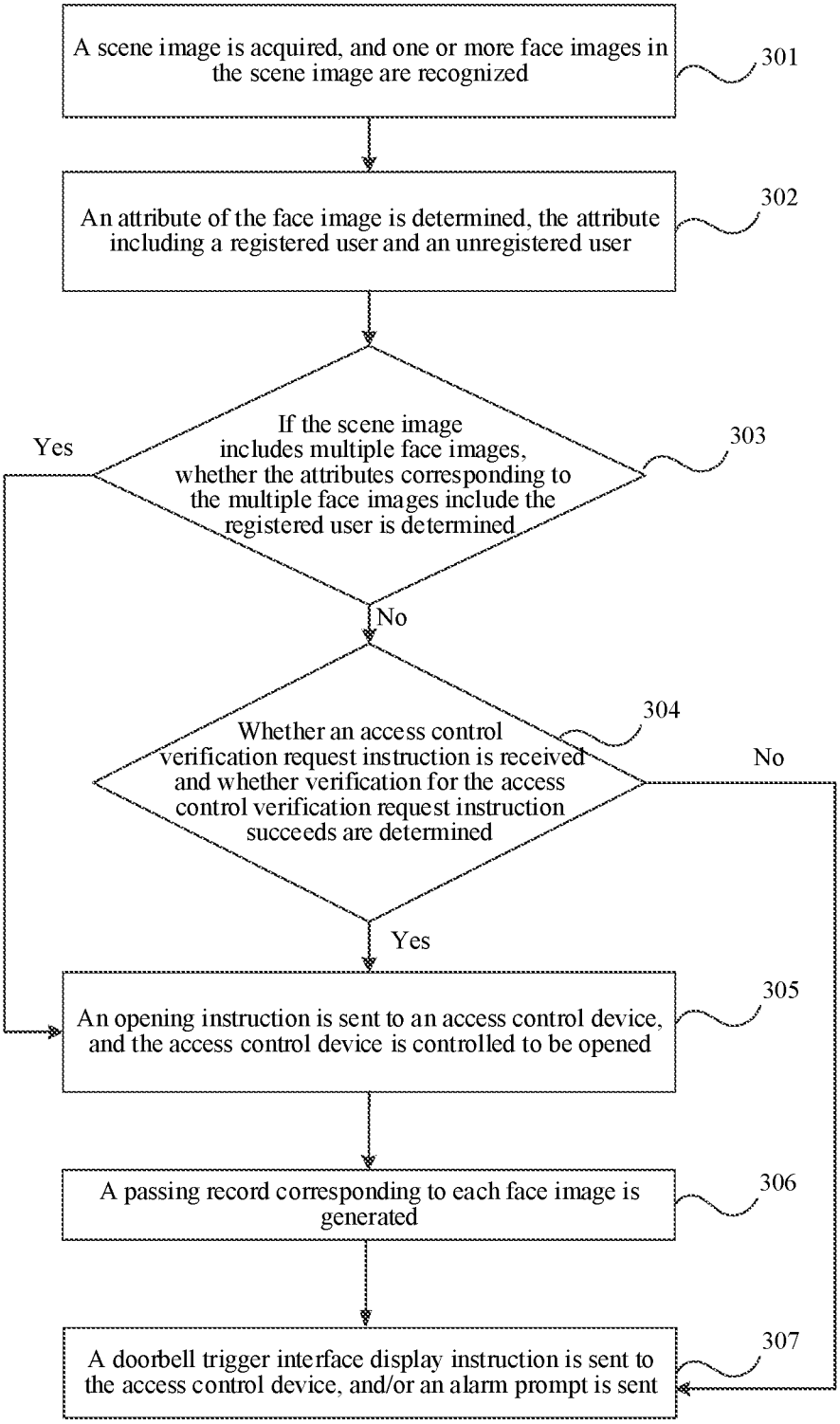
FIG. 3 is a schematic flowchart of another access control method provided in embodiments.

Referring to FIG. 3, FIG. 3 is a schematic flowchart of another access control method disclosed in embodiments. As shown in FIG. 3, the method includes the following operations.

In block 301, a scene image is acquired, and one or more face images in the scene image are recognized.

In some embodiments, an access control apparatus controls a photographing means to acquire the scene image; after photographing the scene image, the photographing means transmits the scene image to the access control apparatus; and then the access control apparatus recognizes at least one face in the scene image, where when there are multiple faces in the scene image, the access control apparatus can recognize the multiple faces at the same time. A method for face recognition includes a geometric feature-based face recognition method, an algebraic feature-based face recognition method, a connection mechanism-based face recognition method, a three-dimensional data-based face recognition method, and/or a neural network-based face recognition method. In addition, the scene image is an image including visitors within a predetermined range of an access control device photographed by the photographing means.

In the embodiments, the photographing means includes, but is not limited to, at least one of a camera, a camera lens, or a digital camera. Therefore, compared with the implementation of a complete process from the obtaining of the scene image to the recognition of a specific face during recognition on each face, multiple faces in a scene image are recognized at the same time, so that the recognition efficiency is greatly improved, and the time spent from recognition to verification is shortened.

It should be noted that the access control apparatus can control the photographing means to photograph, at a fixed position, an area within the predetermined range around the access control device to obtain the scene image, or control a lens of the photographing means to rotate or zoom to capture an area of a crowd in a hall and photograph the area of the crowd to obtain the scene image. The photographing means may be included in the access control apparatus and may also be included in another terminal device, or is an external means, which is not limited in the embodiments. An access control system as shown in FIG. 5 includes the access control apparatus and the access control device, where the access control device is a device used for restricting the in and out of the visitors and let the visitors pass one by one, and the access control apparatus is an apparatus used for controlling the access control device to be opened or closed.

It should be further noted that a method for implementing multi-face recognition of the access control apparatus relates to parallel recognition. In practical application, parallel recognition may be parallel recognition in terms of time or parallel recognition in terms of step. For example, if the parallel recognition above is the parallel recognition in terms of time, the access control apparatus divides time into multiple time slots, such that the access control apparatus performs recognition on a first face at odd time slots and performs recognition on a second face at even time slots, until the two faces are both recognized, i.e., the first face is recognized at time slots 1, 3, 5, . . . , (N+1), and the second face is recognized at time slots 2, 4, 6, . . . , (N+2). Similarly, if the parallel recognition above is the parallel recognition in terms of step, the image acquired by the access control apparatus includes the first face and the second face, such that the access control apparatus performs feature extraction on the second face after performing feature extraction on the first face, and then performs face matching or the like on the first face after performing feature extraction on the second face, until the two faces are both recognized. Therefore, parallel recognition on multiple face images can be achieved.

During practical implementation, one or more face images in the scene image are detected; feature data of the one or more face images is separately extracted; and the feature data of the one or more face images is separately matched with a feature template of a face database.

In some embodiments, in summary, the face recognition above includes face image detection, feature data extraction, and face database matching. For example, the one or more face images in the scene image being detected indicates performing face detection on the scene image, i.e., representing the scene image by using a histogram feature, a color feature, a template feature, a structure feature, or a Haar feature of the scene image, then inputting the scene image in a cascade classifier, and classifying each block in the scene image by using the cascade classifier, where if a certain area of the scene image passes through the cascade classifier, the area is determined to be a face image. It should be further noted that the feature data of the one or more face images being separately extracted indicates extracting a visual feature, a pixel statistical feature, a face image transformation coefficient feature, a face image algebraic feature, or the like of the face image. Face feature extraction is also called as face representation, and relates to a process of performing feature modeling on a face, such as a knowledge-based representation method, where the method mainly relates to obtaining feature data in favor of face classification according to shape features of face organs and distance features between the face organs. The feature data includes a Euclidean distance between feature points, a curvature, an angle, etc.

It should be further noted that the feature data of the one or more face images being separately matched with the feature template of the face database indicates comparing a face feature to be recognized with the obtained face feature template, and making out, according to a similarity degree, whether the face image is similar to a face present in the face database. In practical application, the extracted feature data of the face image and the feature template stored in the face database are subjected to search matching, so as to obtain a similarity between the face image and the face in the face database, where when the similarity exceeds a preset threshold, information on the face in the face database having the similarity to the face image greater than the preset threshold is output.

In one embodiment, after the one or more face images in the scene image are detected and before the feature data of the one or more face images is separately extracted, the method further includes preprocessing the one or more face images.

In some embodiments, the preprocessing the one or more face images indicates performing image preprocessing such as gray-scale correction and noise filtering on the scene image, so as to strengthen and/or reconstruct details of the face image to make the face image more clear. In practical application, the preprocessing on the face image includes light compensation, gray-scale transformation, histogram equalization, normalization, geometric correction, filtering and/or sharpening, etc.

In one embodiment, if the scene image includes multiple face images, body movements between visitors to which the multiple face images respectively belong are recognized; and the multiple face images are identified with a group attribute according to the body movements, the group attribute being used for describing an interpersonal relationship between the visitors to which the multiple faces respectively belong.

In some embodiments, if the scene image includes multiple face images, the body movements between the visitors to which the multiple face images respectively correspond can be further recognized, and then the relationship between the visitors can be inferred from the body movements, for example, the body movements including holding hands, shaking hands, patting on the shoulder, etc. If two visitors are shaking hands and/or patting on the shoulders, it is inferred that the two visitors may be colleagues. Similarly, if two visitors are holding hands, it is inferred that the two visitors may be a couple. Therefore, the access control apparatus can group the visitors as different groups by recognizing different body movements between the visitors. By means of the method, a simple human relationship network can be established, more information on the visitors can be obtained, and then the human relationship network can be used when necessary.

In block 302, an attribute of the face image is determined, the attribute including a registered user and an unregistered user.

In some embodiments, during face image recognition, if the face image included in the scene image has a matched face image in the face database, the attribute of the face image is the registered user; otherwise, the attribute of the face image is the unregistered user. If the attribute of the face image is the registered user, it indicates that a visitor corresponding to the face image is the registered user, such as an employee and a short-term visitor; otherwise, if the attribute of the face image is the unregistered user, it indicates that the visitor corresponding to the face image is the unregistered user, such as a strange visitor.

In block 303, if the scene image includes multiple face images, it is determined whether the attributes corresponding to the multiple face images include the registered user; if the attributes corresponding to the multiple face images include the registered user, the operation in block 305 is implemented; if the attributes corresponding to the multiple face images include the unregistered user, the operation in block 304 is implemented.

In practical application, if the scene image recognized by the access control apparatus includes multiple face images, and the multiple face images include the face image of which the attribute is the registered user, it indicates that the crowd corresponding to the multiple face images has the registered user, and if the multiple face images do not include the face image of which the attribute is the registered user, it indicates that the crowd is all the unregistered users.

In one embodiment, in the case that the attributes corresponding to the multiple face images include the registered user and the number of the registered users is less than the number of the face images, an alarm prompt is sent.

In one or more embodiments, if the scene image includes multiple face images, and the number of the face images, of which the attributes are the registered users, in the multiple face images is less than the number of the face images, it indicates that although the multiple face images include the face image of which the attribute is the registered user, the face image of which the attribute is the unregistered user is also included. That is, it indicates that the crowd corresponding to the multiple face images has the unregistered user. Therefore, in order to strengthen security protection, the access control apparatus sends the alarm prompt, to prompt an administrator to pay attention to that the crowd has the unregistered user, and also to prompt the unregistered user that it is necessary to perform identity verification before access.

In block 304, it is determined whether an access control verification request instruction is received and whether verification for the access control verification request instruction succeeds; if yes, the operation in block 305 is implemented; otherwise, the operation in block 307 is implemented.

In some embodiments, if the multiple face images are all the face images of which the attributes are the unregistered users, it indicates that the crowd corresponding to the multiple face images is all the unregistered users. Therefore, if the crowd wants to pass, it is necessary to perform verification, i.e., the access control verification request instruction is input on the access control device, then after receiving the access control verification request instruction, the access control device sends same to the access control apparatus, and finally the access control apparatus determines, by means of whether the received access control verification request instruction is correct, whether verification for the visitor succeeds, where if the verification succeeds, the operation in block 305 is implemented; otherwise, the operation in block 307 is implemented. The access control verification request instruction includes an access control password, etc.

It should be noted that if the visitors are the unregistered users, it indicates that the visitors are strange visitors, i.e., neither company employees nor outsiders who have already registered. Therefore, it is necessary to verify whether the visitors are legitimate visitors, for example, making the visitors enter the access control password. The visitors can make an appointment to get a random password by applying at the front desk or on a company website, which is not limited in the embodiments. If the password verification succeeds, the visitors can obtain the authority for passing.

In block 305, an opening instruction is sent to the access control device, and the access control device is controlled to be opened.

In some embodiments, if the multiple face images include the face image of which the attribute is the registered user, it indicates that the crowd corresponding to the multiple face images has the registered user. In this case, the multiple visitors in front of the access control apparatus may know each other, and therefore, the multiple visitors can be allowed to pass when the registered user is detected. Therefore, the access control apparatus sends the opening instruction to the access control device to open the access control device. Another situation is that if the multiple face images do not include the face image of which the attribute is the registered user, it indicates that the crowd corresponding to the multiple face images does not include the registered user. In this case, if the access control apparatus receives the access control verification request instruction, and the access control verification request instruction is verified to be correct, the access control apparatus sends the opening instruction to the access control device to open the access control device.

In block 306, a passing record corresponding to each face image is generated.

In some embodiments, in the case of sending the opening instruction to the access control device, and controlling the access control device to be opened, the passing record corresponding to each face image is generated, where the passing record includes at least one of a passing time, an address, or the face image. When sending the opening instruction to the access control device to control the access control device to be opened, the access control apparatus further needs to record the passing records of the passing visitors, i.e., generating the corresponding passing records, each including the passing time, the address, etc., for different face images, to associate the face images with the passing records, so that the administrator can later query the passing records of the visitors.

In one embodiment, access authority modification information for a first face image is received, the access authority modification information including an access site, an access frequency, and/or an access time; and an access authority corresponding to the first face image is modified according to the access authority modification information. In the embodiments, in addition to associating with the passing records, the face images also associate with the access authority. Therefore, the access control apparatus can modify the access authority of the registered user. In practical application, when the access control apparatus receives the access authority modification information of the first face image, the access authority of the first face image is modified according to the access site, the access frequency, and/or the access time in the access authority modification information. Therefore, the visitor corresponding to the first face image is only allowed to access a designated site at a limited frequency within an allowable time period, for example, according to the access authority of the visitor, the visitor only has the authority of accessing a company at the ninth floor for three times, and the access time is just between 2 pm and 6 pm. Similarly, after the unregistered user passes the identity verification, i.e., the access control verification request instruction, the access control apparatus saves the face image of the unregistered user and the associated passing record. Therefore, the unregistered user is also changed as the registered user. The first face image may be any existing face image in the face database, i.e., a face image of which the attribute is the registered user.

In one embodiment, after the verification for the access control verification request instruction succeeds, a registration information obtaining instruction is sent to the access control device; registration information sent by the access control device is received, the registration information including biological feature information; and the registration information is associated with the face image.

In some embodiments, after the verification for the access control verification request instruction succeeds, the access control apparatus can send the registration information obtaining instruction to the access control device so that the access control device displays prompt information to prompt the visitor to input the biological feature information such as fingerprint, voiceprint, and iris information, and then associate the biological feature information of the visitor with the face image of the visitor to further complete information on the visitor. Since the biological feature information of each person is different, the biological feature information can effectively ensure the uniqueness and authenticity of the identity of the visitor.

In one embodiment, after the verification for the access control verification request instruction succeeds, access information is obtained according to the access control verification request instruction, the access information including identity information, an access object, an access reason, and/or information on a receptor; and the access information is associated with the face image.

In some embodiments, after the verification for the access control verification request instruction succeeds, the access control apparatus can also obtain the access information of the visitor according to the access control verification request instruction returned by the access control device. The access information comes from a terminal device at the front desk of a company or a server with company official website data stored thereon, and is information input at the front desk or on the official website before the visitor passes through the access control device, which is not limited in the embodiments. Moreover, the access information includes the access identity, the access object, the access reason, and the information on the receptor.

In block 307, a doorbell trigger interface display instruction is sent to the access control device; and/or an alarm prompt is sent.

In some embodiments, if the access control apparatus does not receive the access control verification request instruction, or if the access control apparatus receives the access control verification request instruction but the verification for the access control verification request instruction fails, the access control apparatus sends the doorbell trigger interface display instruction to the access control device, and then the access control device displays a doorbell trigger interface, the doorbell trigger interface including an icon for triggering a doorbell to ring, such that the visitor can make a video or voice conversation with the administrator by clicking on the icon to trigger a doorbell. After verifying the identity of the visitor remotely, the administrator sends an identity confirmation result to the access control device, and then the access control apparatus controls the access control device to be opened, thereby verifying the identity of the visitor by operating remotely by the administrator, and improving the access control efficiency. In addition, the access control apparatus can also send the alarm prompt, such as flashing the alarm light, ringing the alarm, and/or displaying the warning. Therefore, the administrator can be prompted of the presence of the unregistered user and the unregistered user is prompted to make input again.

Compared with the previous embodiments, the embodiments upgrade visitor management. The previous embodiments mainly describe methods for performing identity verification on the visitors and for restricting the passing of the visitors. However, in the embodiments, a passing condition of the visitor is further recorded, and a handling method in the case that the verification for the access control verification request instruction fails is added. Therefore, the embodiments improve the access control device passing efficiency and the access control security.

Figure 4:
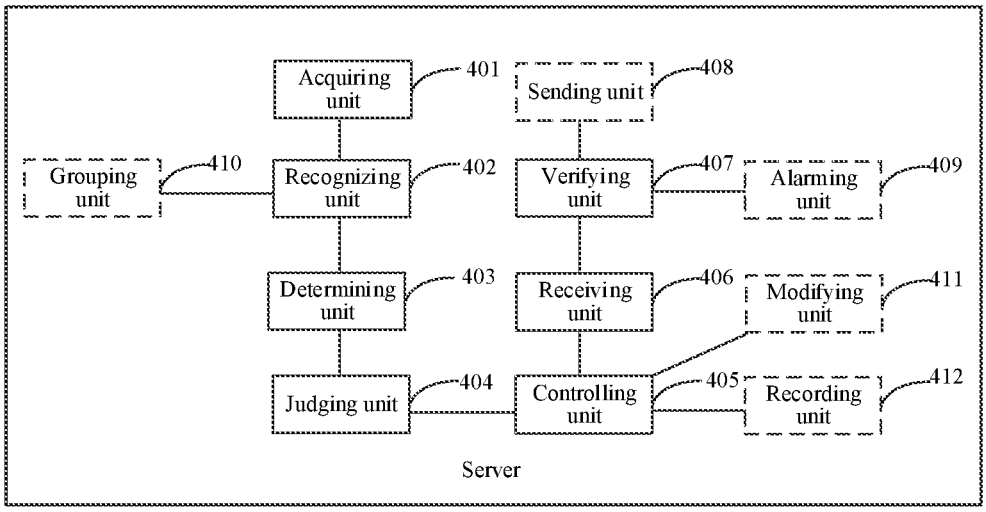
FIG. 4 is a structural block diagram of an access control system provided in embodiments.

The embodiments also provide an access control apparatus, where the access control apparatus includes units used for implementing the method according to the first embodiment. In practical application, FIG. 4 is a structural block diagram of an access control apparatus disclosed in embodiments. The access control apparatus of the embodiments includes: an acquiring unit 401, a recognizing unit 402, a determining unit 403, a judging unit 404, a controlling unit 405, a receiving unit 406, and a verifying nit 407. In one embodiment, the acquiring unit 401 is configured to acquire a scene image;

the recognizing unit 402 is configured to recognize one or more face images in the scene image;

the determining unit 403 is configured to determine an attribute of the face image, the attribute including a registered user and an unregistered user;

the judging unit 404 is configured to, in response to a situation where the scene image includes multiple face images, determine whether the attributes corresponding to the multiple face images include the registered user;

the controlling unit 405 is configured to, if the attributes corresponding to the multiple face images include the registered user, send an opening instruction to an access control device, and control the access control device to be opened;

the receiving unit 406 is configured to receive an access control verification request instruction; accordingly, the judging unit 404 is further configured to determine whether the access control verification request instruction is received;

the verifying unit 407 is configured to verify the access control verification request instruction; and the controlling unit 405 is further configured to, in response to reception of the access control verification request instruction, in the case that verification for the access control verification request instruction succeeds, send the opening instruction to the access control device, and control the access control device to be opened.

In one embodiment, the access control apparatus further includes a sending unit 408, configured to send a doorbell trigger interface display instruction to the access control device in the case that the verification for the access control verification request instruction fails.

In one embodiment, the access control apparatus further includes an alarming unit 409, configured to send an alarm prompt.

In one embodiment, the alarming unit 409 is further configured to, in the case that the attributes corresponding to the multiple face images include the registered user and the number of the registered users is less than the number of the face images, send an alarm prompt.

In one embodiment, the judging unit 404 is further configured to, in response to a situation where the scene image includes one face image, determine whether the attribute of the face image is the registered user.

In one embodiment, the controlling unit 405 is further configured to, if the attribute of the face image is the registered user, send the opening instruction to the access control device, and control the access control device to be opened.

In one embodiment, the judging unit 404 is further configured to determine whether the access control verification request instruction is received; and in one embodiment, the controlling unit 405 is further configured to, in response to reception of the access control verification request instruction, in the case that verification for the access control verification request instruction succeeds, send the opening instruction to the access control device, and control the access control device to be opened.

In one embodiment, the recognizing unit 402 is further configured to recognize body movements between visitors to which the multiple face images respectively belong.

In one embodiment, the access control apparatus further includes a grouping unit 410, configured to identify the multiple face images with a group attribute according to the body movements, the group attribute being used for describing an interpersonal relationship between the visitors to which the multiple faces respectively belong.

In one embodiment, the receiving unit 406 is further configured to receive access authority modification information for a first face image, the access authority modification information including an access site, an access frequency, and/or an access time.

In one embodiment, the access control apparatus further includes a modifying nit 411, configured to modify an access authority corresponding to the first face image according to the access authority modification information.

In one embodiment, the access control apparatus further includes a recording unit 412, configured to, in the case of sending the opening instruction to the access control device, and controlling the access control device to be opened, generate a passing record corresponding to each face image, where the passing record includes at least one of a passing time, an address, or the face image.

In the embodiments, the recognizing unit can recognize at least one face in the scene image; when the scene image has multiple faces, the recognizing unit can recognize the multiple faces in parallel. Therefore, compared with the implementation of a complete process from the obtaining of the scene image to the recognition of a specific face during recognition on each face, the multiple faces in a scene image are recognized at the same time, so that the recognition efficiency is greatly improved, and the time spent from recognition to verification is shortened. Moreover, since the recognizing unit has performed face recognition on the visitor before the visitor arrives in front of the access control device, whether the visitor to which the face belongs is a face in a face database is recognized, and then the judging unit determines, according to the previous recognition result when the visitor passes through the access control device, whether the visitor who needs to be verified at present is a long-term visitor or a short-term visitor, and only the long-term visitor or the short-term visitor can pass smoothly. Therefore, it can be seen that the visitor has been recognized before passing through the access control device, thereby shortening the time spent from recognition to verification; moreover, the in an out of a strange visitor is effectively restricted, and an access condition of the strange visitor can be recorded more accurately and effectively. Therefore, the access control efficiency is greatly improved.

It should be noted that please refer to the descriptions on the embodiments of the preceding access control method for specific embodiments of the access control apparatus of the embodiments, which will not be repeatedly described here.

The embodiments further provide an access control system. As shown in FIG. 5, the access control system includes an access control apparatus 510 and an access control device 520, where the access control apparatus 510 is configured to control the access control device 520 to be opened or closed so as to restrict the passing of the visitor. In practical application, the access control apparatus 510 is configured to implement the method according to the first embodiment.

It should be further noted that the access control apparatus 510 further includes a processing module, a face database, and a photographing module, where the processing module is configured to implement the method according to the first embodiment, the face database is configured to store face images of different registered visitors, and the photographing module is configured to photographing the image of the visitor.

It should be further noted that the face database and the photographing module may be included in the access control apparatus, and may not be included in the access control apparatus but exist in another terminal device, a server, or an external independent peripheral device, which is not limited in the embodiments.

Figure 6:
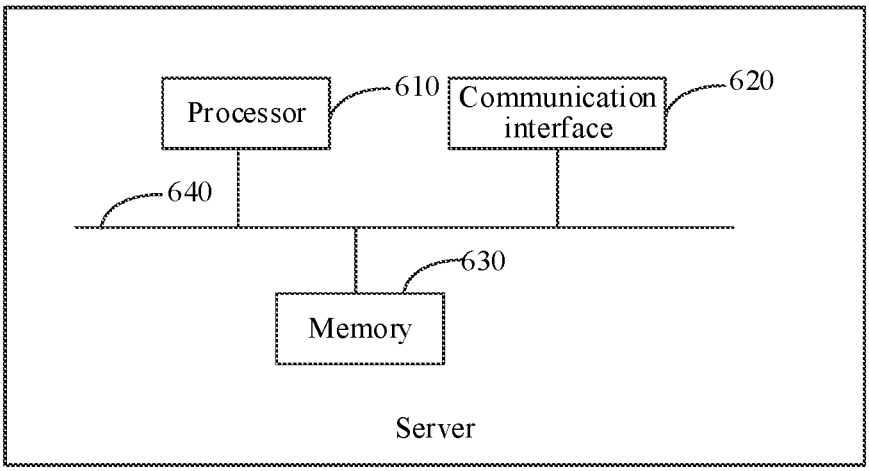
FIG. 6 is a structural block diagram of an access control apparatus provided in embodiments.

Referring to FIG. 6, the embodiments provide another access control apparatus, including one or more processors 610, a communication interface 620, and a memory 630, which are connected to each other by means of a bus 640, where the communication interface 620 is configured to exchange data with other electronic devices, the memory 630 is configured to store a computer program including program instructions, and the processor 610 is configured to invoke the program instructions, so as to implement the method according to the embodiments above. In one embodiment, the processor 610 is configured to execute the function of a recognizing unit 402, i.e., recognizing one or more face images in a scene image, is further configured to execute the function of a determining unit 403, i.e., determining an attribute of the face image, the attribute including a registered user and an unregistered user, is further configured to execute the function of a judging unit 404, i.e., in response to a situation where the scene image includes multiple face images, determining whether the attributes corresponding to the multiple face images include the registered user, and is further configured to execute the function of a controlling unit 405, i.e., if the attributes corresponding to the multiple face images include the registered user, sending an opening instruction to an access control device, and controlling the access control device to be opened; and the communication interface 620 is configured to execute the function of an acquiring unit 401, i.e., acquiring the scene image, and is further configured to execute the function of a receiving unit 406, i.e., receiving an access control verification request instruction.

In one embodiment, the processor 610 is further configured to determine whether the access control verification request instruction is received, and execute the function of a verifying unit 407, i.e., verifying the access control verification request instruction; and is further configured to, in response to reception of the access control verification request instruction, in the case that verification for the access control verification request instruction succeeds, send the opening instruction to the access control device, and control the access control device to be opened.

In one embodiment, the communication interface 620 is further configured to execute the function of a sending unit 408, i.e., in the case that the verification for the access control verification request instruction fails, send a doorbell trigger interface display instruction to the access control device; is further configured to execute the function of an alarming unit 409, i.e., sending an alarm prompt; is further configured to, in the case that the attributes corresponding to the multiple face images include the registered user and the number of the registered uses is less than the number of the face images, send the alarm prompt; is further configured to, in response to a situation where the scene image includes one face image, determine whether the attribute of the face image is the registered user; is further configured to, if the attribute of the face image of the registered user, send the opening instruction to the access control device, and control the access control device to be opened; is further configured to determine whether the access control verification request instruction is received; is further configured to, in response to reception of the access control verification request instruction, in the case that the verification for the access control verification request instruction succeeds, send the opening instruction to the access control device, and control the access control device to be opened; and is further configured to recognize body movements between visitors to which the multiple face images respectively belong.

In one embodiment, the processor 610 is further configured to execute the function of a grouping unit 410, i.e., identifying the multiple face images with a group attribute according to the body movements, the group attribute being used for describing an interpersonal relationship between the visitors to which the multiple faces respectively belong.

In one embodiment, the processor 610 is further configured to receive access authority modification information for a first face image, the access authority modification information including an access site, an access frequency, and/or an access time.

In one embodiment, the processor 610 is further configured to execute the function of a modifying unit 411, i.e., modifying an access authority corresponding to the first face image according to the access authority modification information.

In one embodiment, the processor 610 is further configured to execute the function of a recording unit 412, i.e., in the case of sending the opening instruction to the access control device, and controlling the access control device to be opened, generate a passing record corresponding to each face image, where the passing record includes at least one of a passing time, an address, or the face image.

It should be understood that in the embodiments, the processor 610 may be a Central Processing Unit (CPU) and may also be another general purpose processor, a Digital Signal Processor (DSP), an Application Specific Integrated Circuit (ASIC), a Field-Programmable Gate Array (FPGA), or another programmable logic device, a discrete gate or transistor logic device, a discrete hardware assembly, or the like. The general purpose processor may be a microprocessor, or the processor may be any conventional processor or the like.

The memory 630 may include a read-only memory and a random access memory, and provides instructions and data to the processor 610. A part of the memory 630 may further include a non-volatile random access memory. For example, the memory 630 may further store information of device type.

The processor 610, the communication interface 620, and the memory 630 described in the embodiments can implement implementations described in the first, second, and third embodiments of the access control method provided in the embodiment, and can also implement implementations of the access control apparatus described in the embodiments. Details are not described herein again.

The embodiments further provide a computer readable storage medium, where the computer readable storage medium stores a computer program, the computer program includes program instructions, and the program instructions are executed by a processor for use to implement the method according to the embodiments above.

The computer readable storage medium may be an internal storage unit of the access control apparatus according to any embodiment above, such as a hard disk or a memory in the access control apparatus. The computer readable storage medium may also be an external storage device of the access control apparatus, such as an insertion-type hard disk drive, a Smart Media Card (SMC), a Secure Digital (SD) card, and a flash card configured on the access control apparatus. Furthermore, the computer readable storage medium can further include both the internal storage unit and the external storage device of the access control apparatus. The computer readable storage medium is used for storing a computer program and other programs and data required by the access control apparatus. The computer readable storage medium can further be used for temporarily store output data or data to be output.

Persons skilled in the art can understand that the individual exemplary units and arithmetic steps that are described in conjunction with the embodiments disclosed herein are able to be implemented in the electronic hardware, the computer software or a combination thereof. For describing the interchangeability between the hardware and the software clearly, the components and the steps of each example have been described according to the function generally in the description above. Whether these functions are performed by hardware or software depends on the particular applications and design constraint conditions of the technical solutions. Persons skilled in the art may use different methods to implement the described functions for each particular application, but it should not be considered that the implementation goes beyond the scope of the present disclosure.

Persons skilled in the art can clearly understand that for convenience and brevity of description, reference is made to corresponding process descriptions in the foregoing method embodiments for the specific working processes of the server and the units described above, and details are not described herein again.

It should be understood that the disclosed server and method in the embodiments provided in the present disclosure may be implemented by other modes. For example, the apparatus embodiments described above are merely exemplary. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented by means of some interfaces, apparatuses or units. The indirect couplings or communication connections between the apparatuses or units may be implemented in electronic, mechanical, or other forms.

The units described as separate parts may or may not be physically separate, and the parts displayed as units may or may not be physical units, may be located in one position, or may be distributed on a plurality of network units. A part of or all of the units may be selected according to actual needs to achieve the objectives of the solutions of the embodiments.

In addition, functional units in the embodiments of the present disclosure may be integrated into one processing unit, or each of the units may exist alone physically, or two or more units may be integrated into one unit. The integrated unit may be implemented in a form of hardware and may also be implemented in a form of a software functional unit.

When the integrated module/unit is implemented in a form of a software functional unit and sold or used as an independent product, the integrated module/unit may be stored in a computer readable storage medium. Based on such an understanding, the technical solutions of the present disclosure or a part thereof contributing to the prior art may be essentially embodied in the form of a software product. The computer software product is stored in one storage medium and includes several instructions so that one computer device (which may be a personal computer, a server, a network device, and the like) implements all or part of steps of the method in the embodiments of the present disclosure. Moreover, the preceding storage medium includes: media having program codes stored such as a USB flash drive, a mobile hard disk drive, a Read-only Memory (ROM), a floppy disk, and an optical disc.

The invention claimed is:

1. An access control method, comprising:

acquiring a scene image, and recognizing at least one face image in the scene image;

determining an attribute of the at least one face image, wherein the attribute comprises a registered user and an unregistered user;

when the scene image comprises multiple face images, determining whether attributes corresponding to the multiple face images comprise the registered user;

in response to determining that the attributes corresponding to the multiple face images comprise the registered user, sending an opening instruction to an access control device, and controlling the access control device to be opened;

in response to determining that the attributes corresponding to the multiple face images comprise no registered user, determining whether an access control verification request instruction is received; and in response to reception of the access control verification request instruction, in condition that verification for the access control verification request instruction succeeds, sending the opening instruction to the access control device, and controlling the access control device to be opened, wherein the access control verification request instruction comprises an access control password obtained in advance by the unregistered user, and in response to reception of the access control verification request instruction, in condition that verification for the access control verification request instruction succeeds, sending the opening instruction to the access control device comprises:

receiving the access control password input through the access control device, and sending the opening instruction to the access control device if verification of the access control password succeeds, the method further comprising:

sending the doorbell trigger interface display instruction to the access control device in condition that the verification for the access control verification request instruction fails.

2. The method according to claim 1, further comprising:

in condition that the verification for the access control verification request instruction fails, sending an alarm prompt.

3. The method according to claim 1, further comprising:

in condition that the attributes corresponding to the multiple face images comprise the registered user and a number of the registered users is less than a number of the multiple face images, sending an alarm prompt.

4. The method according to claim 1, further comprising:

when the scene image comprises one face image, determining whether an attribute of the face image is the registered user;

in response to determining that the attribute of the face image is the registered user, sending the opening instruction to the access control device, and controlling the access control device to be opened; in response to determining that the attribute of the face image is the unregistered user, determining whether the access control verification request instruction is received; and in response to reception of the access control verification request instruction, in condition that the verification for the access control verification request instruction succeeds, sending the opening instruction to the access control device, and controlling the access control device to be opened.

5. The method according to claim 4, further comprising:

in condition that the verification for the access control verification request instruction fails, sending an alarm prompt.

6. The method according to claim 1, after recognizing the multiple face images in the scene image, the method further comprises:

recognizing body movements between visitors in the recognized multiple face images, each visitor corresponding to a respective one of the multiple face images and having corresponding body movements; and identifying the multiple face images with a group attribute according to the body movements, the group attribute being used for describing an interpersonal relationship between the visitors to which the multiple faces belong.

7. The method according to claim 1, further comprising:

receiving access authority modification information for a first face image, the access authority modification information comprising at least one of an access site, an access frequency, or an access time; and modifying an access authority corresponding to the first face image according to the access authority modification information.

8. The method according to claim 1, further comprising:

in a case of sending the opening instruction to the access control device, and controlling the access control device to be opened, generating a passing record corresponding to each face image, wherein the passing record comprises at least one of a passing time, an address, or the face image.

9. The method according to claim 1, further comprising:

in response to determining that the attributes corresponding to the multiple face images comprise no registered user, receiving an access control verification code; and in condition that verification for the access control verification code succeeds, sending the opening instruction to the access control device and controlling the access control device to be opened.

10. An access control apparatus, comprising: a processor, a communication interface, and a memory for storing instructions executable by the processor, which are connected to each other, wherein the communication interface is configured to acquire a scene image, and receive an access control verification request instruction; and the processor is configured to:

recognize at least one face image in the scene image;

determine an attribute of the at least one face image, wherein the attribute comprises a registered user and an unregistered user;

when the scene image comprises multiple face images, determine whether attributes corresponding to the multiple face images comprise the registered user;

in response to determining that the attributes corresponding to the multiple face images comprise the registered user, send an opening instruction to an access control device, and control the access control device to be opened;

in response to determining that the attributes corresponding to the multiple face images comprise no registered user, determine whether an access control verification request instruction is received; and in response to reception of the access control verification request instruction, in condition that verification for the access control verification request instruction succeeds, send the opening instruction to the access control device, and control the access control device to be opened, wherein the access control verification request instruction comprises an access control password obtained in advance by the unregistered user, and the operation of in response to reception of the access control verification request instruction, in condition that verification for the access control verification request instruction succeeds, sending the opening instruction to the access control device comprises:

receiving the access control password input through the access control device, and sending the opening instruction to the access control device if verification of the access control password succeeds, wherein the communication interface is further configured to:

send a doorbell trigger interface display instruction to the access control device in condition that the verification for the access control verification request instruction fails.

11. The access control apparatus according to claim 10, wherein the communication interface is further configured to:

in condition that the verification for the access control verification request instruction fails, sending an alarm prompt.

12. The access control apparatus according to claim 10, wherein the communication interface is further configured to:

in condition that the attributes corresponding to the multiple face images comprise the registered user and a number of the registered users is less than a number of the multiple face images, send an alarm prompt.

13. The access control apparatus according to claim 10, wherein the processor is further configured to:

when the scene image comprises one face image, determine whether an attribute of the face image is the registered user;

in response to determining that the attribute of the face image is the registered user, send the opening instruction to the access control device, and control the access control device to be opened;

determine whether the access control verification request instruction is received; and in response to reception of the access control verification request instruction, in condition that the verification for the access control verification request instruction succeeds, send the opening instruction to the access control device, and control the access control device to be opened.

14. The access control apparatus according to claim 13, wherein the communication interface is further configured to:

in condition that the verification for the access control verification request instruction fails, sending an alarm prompt.

15. The access control apparatus according to claim 10, wherein the processor is further configured to:

recognize body movements between visitors in the recognized multiple face images, each visitor corresponding to a respective one of the multiple face images and having corresponding body movements; and identify the multiple face images with a group attribute according to the body movements, the group attribute being used for describing an interpersonal relationship between the visitors to which the multiple faces belong.

16. The access control apparatus according to claim 10, wherein the communication interface is further configured to:

receive access authority modification information for a first face image, the access authority modification information comprising at least one of an access site, an access frequency, or an access time; and the processor is configured to modify an access authority corresponding to the first face image according to the access authority modification information.

17. The access control apparatus according to claim 10, wherein the processor is further configured to:

in a case of sending the opening instruction to the access control device, and controlling the access control device to be opened, generate a passing record corresponding to each face image, wherein the passing record comprises at least one of a passing time, an address, or the face image.

18. The access control apparatus according to claim 10, wherein the communication interface is further configured to:

in response to determining that the attributes corresponding to the multiple face images comprise no registered user, receive an access control verification code; and wherein the processor is further configured to:

in condition that verification for the access control verification code succeeds, send the opening instruction to the access control device and control the access control device to be opened.

19. A non-transitory computer readable storage medium, having stored thereon a computer program, the computer program comprising program instructions that, when being executed by a processor, causes to processor to implement the following:

acquiring a scene image, and recognizing at least one face image in the scene image;

determining an attribute of the at least one face image, wherein the attribute comprises a registered user and an unregistered user;

when the scene image comprises multiple face images, determining whether attributes corresponding to the multiple face images comprise the registered user;

in response to determining that the attributes corresponding to the multiple face images comprise the registered user, sending an opening instruction to an access control device, and controlling the access control device to be opened;

in response to determining that the attributes corresponding to the multiple face images comprise no registered user, determining whether an access control verification request instruction is received; and in response to reception of the access control verification request instruction, in condition that verification for the access control verification request instruction succeeds, sending the opening instruction to the access control device, and controlling the access control device to be opened, wherein the access control verification request instruction comprises an access control password obtained in advance by the unregistered user, and in response to reception of the access control verification request instruction, in condition that verification for the access control verification request instruction succeeds, sending the opening instruction to the access control device comprises:

receiving the access control password input through the access control device, and sending the opening instruction to the access control device if verification of the access control password succeeds, wherein the computer program comprising program instructions that, when being executed by a processor, causes to processor to implement:

sending the doorbell trigger interface display instruction to the access control device in condition that the verification for the access control verification request instruction fails.

* * * * *